United States Patent [19]

Tanimoto et al.

[11] Patent Number: 4,993,763

[45] Date of Patent: Feb. 19, 1991

[54] DOOR INSIDE HANDLE DEVICE

[75] Inventors: Tetsurou Tanimoto, Kariya; Yukio Isomura, Chiryu; Noboru Kanou, Toyota, all of Japan

[73] Assignee: Aisin Seiki Kabushiki Kaisha, Kariya, Japan

[21] Appl. No.: 410,064

[22] Filed: Sep. 21, 1989

[30] Foreign Application Priority Data

Sep. 23, 1988 [JP] Japan ..... 63-239240

[51] Int. Cl.[5] ..... E05B 1/00

[52] U.S. Cl. ..... 292/336.3; 292/347

[58] Field of Search ..... 292/347, 336.3, DIG. 31, 292/DIG. 61

[56] References Cited

U.S. PATENT DOCUMENTS

| | | | |
|---|---|---|---|
| 2,752,186 | 6/1936 | Morrison | 292/DIG. 31 X |
| 3,129,025 | 4/1964 | Krueger | 292/DIG. 5 X |
| 3,528,695 | 9/1970 | Peters | 292/336.3 |
| 3,544,148 | 12/1970 | Sandor | 292/336.3 |
| 3,606,428 | 9/1971 | Erch et al. | 292/336.3 |
| 4,268,077 | 5/1981 | Bohleen et al. | 292/DIG. 61 X |
| 4,497,514 | 2/1985 | Moriya et al. | 292/336.3 |
| 4,778,207 | 10/1988 | Gergoe | 292/336.3 |
| 4,838,590 | 6/1989 | Isomura | 292/DIG. 31 X |

*Primary Examiner*—Eric K. Nicholson

*Attorney, Agent, or Firm*—Finnegan, Henderson, Farabow, Garrett and Dunner

[57] ABSTRACT

A door inside handle device, typically for a vehicle door, having a base plate, an opening handle rotatably mounted on the base plate, and a locking knob rotatably mounted on the base plate above an upper portion of the opening handle, includes a circular hole and an arcuate-shaped elongated hole or slot formed on an upper surface of the locking knob, a first hinge pin of the opening handle penetrating the slot, a second hinge pin of the locking knob penetrating the circular hole, and a hinge center or axis of the locking knob located offset from a hinge center or axis of the opening handle in a direction opposite to the direction of force applicable to the opening handle. The device includes a spring for biasing the opening handle to a certain position with respect to the baseplate. The handle and knob outer surfaces, farthest into interior vehicle space, are substantially flush with one another.

4 Claims, 1 Drawing Sheet

DOOR INSIDE HANDLE DEVICE

BACKGROUND OF THE INVENTION

1. Field of the Invention

This invention relates to a door inside handle device and more particularly to a door inside handle device used for a vehicle door apparatus.

2. Description of the Related Art

In a conventional door inside handle device which is integrally assembled with a locking knob provided on an upper portion of an opening handle, both the hinge center of the opening handle and the hinge center of the locking knob are the same. Therefore, even when a relatively small known operating torque is required as a setting value for the locked state or the unlocked state, a large moment arm of the locking knob must be maintained to limit the required operating force of the locking knob. As a result, an operating portion of the locking knob should be projected from a surface of the opening handle within a vehicle chamber into the interior space of the vehicle chamber. Accordingly, an integral feeling of the locking knob with the opening handle is impaired and the locking knob itself becomes very large and intrusive and the space within the vehicle chamber is impaired.

SUMMARY OF THE INVENTION

It is therefore an object of the present invention to provide a door inside handle device which can obviate the above prior art drawbacks.

It is another object of the present invention to provide a door inside handle device in which the intrusion of a locking knob into the interior vehicle space can be limited without limiting other aspects of the design.

According to the present invention, a hinge center of a locking knob is offset from a hinge center of an opening handle. Accordingly, the distance between the respective hinge centers of the moment arm of the locking knob to an operating point and, thus, the operating force can be suitably determined independently of the other dimensions of the design. Further, even with the operating force of the locking knob suitably determined, the locking knob itself can be limited in size and intrusiveness; and, indeed, its farthest surface into the vehicle can be substantially flush with that of the operating handle.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENT

Figure 1:
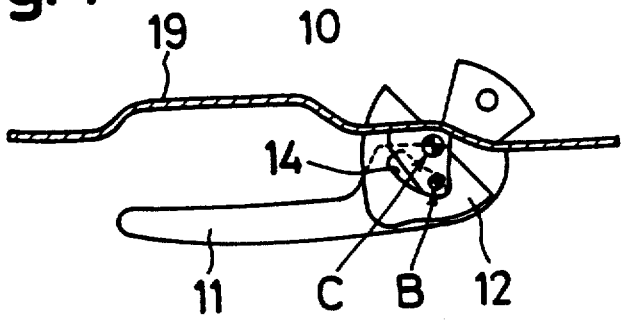
FIG. 1 is a plan view showing a preferred embodiment of a door inside handle device according to the present invention.
Figure 2:
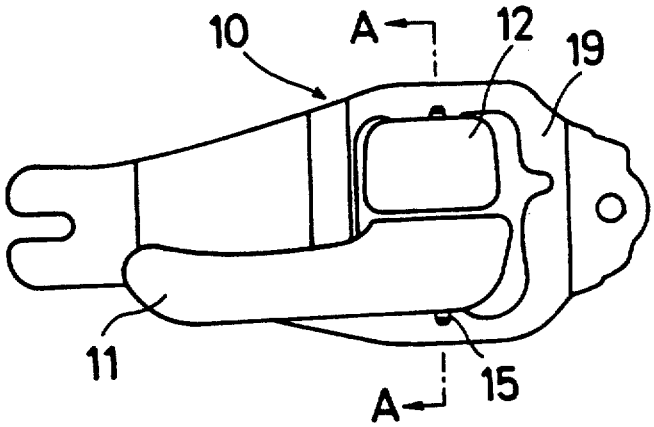
FIG. 2 is a front elevational view of the embodiment of FIG. 1.
Figure 3:
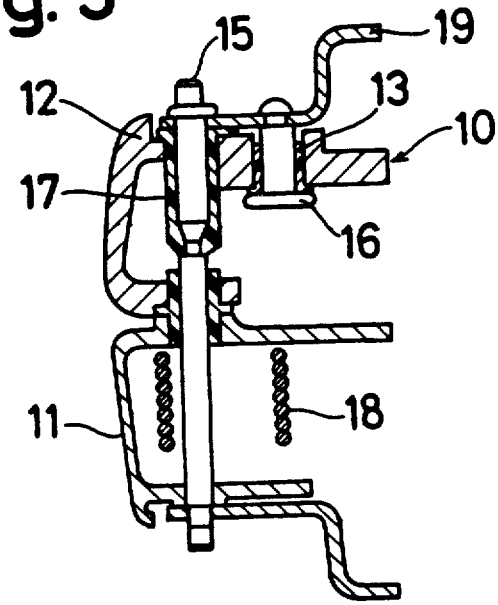
FIG. 3 is an enlarged sectional view taken along section line A—A in FIG. 2.

Referring primarily to FIGS. 1 and 3, which show a preferred embodiment of the present invention, a reference numeral 10 denotes a door inside handle device which has an opening handle 11 and a locking knob 12 mounted adjacently above the opening handle 11. The opening handle 11 and the locking knob 12 are both mounted on a base plate 19 in the door inside handle device 10.

A circular hole 13 (FIG. 3) and an arcuately-shaped elongated hole or slot 14 (FIG. 1) are formed on an upper surface of the locking knob 12. A hinge pin 15 (FIG. 3) penetrates the elongated slot 14. The locking knob 12 is fixedly connected to an inside portion of a base plate 19 by means of a rivet or other fastener through a hinge pin 16 of the locking knob 12 which penetrates the annular hole 13 of the locking knob 12.

As shown in FIG. 1, the opening handle 11 is rotatably mounted to pivot around the hinge center B as an opening force is applied to an inside surface of handle 11 in a direction generally away from base plate 19; and the locking knob 12 is rotatably mounted to pivot around the hinge center C within a certain stroke by a bushing 17 made of a plastic resin provided around the hinge pin 15 of the opening handle 11. The bushing 17 serves as a stopper against the locking knob 12. At this time, the hinge pin 15 of the opening handle 11 permits the slot 14 to slide around it, so that the locking knob 12 becomes rotatable and the range of the rotating stroke of locking knob 12 is limited by the length of the slot 14.

Thus, the hinge center C of the locking knob 12 is offset from the hinge center B of the opening handle 11 in a direction opposite to that in which operating force is applied to opening handle 11, and is located near the base plate 19 in a concavity thereof. Accordingly, the distance between an operating portion of the locking knob 12 and the hinge center C is extended and a necessary moment arm can be obtained for decreasing an operating force of the locking knob 12. The operating surface of the operating portion of knob 12 is parallel to the direction of offset, so that operating force is affectively applied to the moment arm. As a result, the intrusion of locking knob 12 into the vehicle space can be limited.

A reference numeral 18 shows a spring for biasing the opening handle 11 to a certain position.

As above mentioned, the hinge center of the locking knob is offset from the center of the opening handle in accordance with the present invention. Accordingly, the distance between the operating center and the hinge center of the locking knob can be so established, that the moment arm of the locking knob to the operating point can be suitably determined independently of the other dimensions of the design. Further, the operating force of the locking knob can be suitably determined, so that the locking knob itself can be limited in size and intrusiveness. Indeed, the outer surfaces, farthest into the interior of the vehicle, of both operating handle 11 and locking knob 12 are seen to be nearly flush with one another.

The arrangement and function of the remainder of the lock mechanism are well known.

As many apparently widely different embodiments of the present invention can be made without departing from the spirit and scope thereof, it is to be understood that the invention is not limited to the specific embodiments thereof except as defined in the appended claims.

What is claimed is:

1. A door handle device comprising:

a base plate; a first hinge pin; a second hinge pin;

an opening handle rotatably mounted on the base plate to pivot around the first hinge pin, the handle having an inner surface to which force is applicable in a first direction to pivot it away from the base plate;

a locking knob rotatably mounted on the base plate adjacent the handle to pivot around the second hinge pin which is offset from the first hinge pin in a direction at least partially opposed to the first direction, said locking knob having an operating portion at a first distance from the first hinge pin and at a second distance from the second hinge pin, said second distance being greater than said first distance, in which:

the operating handle has an outside surface displaced from the inside surface in the first direction;

the locking knob has a farthest surface in the first direction, said farthest surface being substantially flush with said outside surface; and the locking knob has an arcuate-shaped slot through which the first hinge pin passes, said slot permitting rotational motion of the locking knob as it pivots about the second hinge pin.

2. The door handle device of claim 1, further comprising:

a bushing made of a plastic resin and provided around the first hinge pin for sliding clearance with the arcuate-shaped slot.

3. The door handle device of claim 1, further comprising:

a spring for biasing said opening handle to a certain position with respect to the baseplate.

4. The door handle device of claim 1 in which:

the locking knob requires a operating torque to pivot about the second hinge pin and has an operating surface of the operating portion substantially parallel to the first direction; said second hinge being offset from said first hinge pin in a direction substantially opposite to said first direction, so that an operating force applied to said operating surface is fully effective in supplying said operating torque.

* * * * *